US008561994B1

(12) United States Patent
Jeong et al.

(10) Patent No.: US 8,561,994 B1
(45) Date of Patent: Oct. 22, 2013

(54) GAME VENDING MACHINE

(75) Inventors: Seong Wook Jeong, Goyang (KR); Gyo In Lim, Goyang (KR); Jeong Cheol Kim, Goyang (KR)

(73) Assignee: Komuse Co., Ltd., Gyeonggi-Do (KR)

( * ) Notice: Subject to any disclaimer, the term of this patent is extended or adjusted under 35 U.S.C. 154(b) by 0 days.

(21) Appl. No.: 13/575,255

(22) PCT Filed: Dec. 1, 2011

(86) PCT No.: PCT/KR2011/009246

§ 371 (c)(1),
(2), (4) Date: Jul. 25, 2012

(87) PCT Pub. No.: WO2012/074302

PCT Pub. Date: Jun. 7, 2012

(30) Foreign Application Priority Data

Dec. 2, 2010 (KR) ..... 10-2010-0122035

(51) Int. Cl.
*A63F 9/00* (2006.01)

(52) U.S. Cl.
USPC ..... 273/451; 273/459

(58) Field of Classification Search
USPC ..... 273/447, 448, 459, 460
See application file for complete search history.

(56) References Cited

U.S. PATENT DOCUMENTS

| | | | | |
|---|---|---|---|---|
| 7,600,760 | B2 * | 10/2009 | Matsuda et al. | 273/447 |
| 8,016,292 | B1 * | 9/2011 | Yang et al. | 273/451 |
| 8,079,597 | B1 * | 12/2011 | Wei | 273/451 |
| 8,167,311 | B1 * | 5/2012 | Wang | 273/451 |
| 8,448,944 | B2 * | 5/2013 | Yang et al. | 273/138.1 |
| 8,448,948 | B1 * | 5/2013 | Shoemaker, Jr. | 273/447 |
| 2003/0011133 | A1 * | 1/2003 | Uedono et al. | 273/447 |
| 2008/0242413 | A1 * | 10/2008 | Matsuda | 463/38 |

FOREIGN PATENT DOCUMENTS

| | | | |
|---|---|---|---|
| JP | 2006334270 | A * | 12/2006 |
| JP | 2007044413 | A * | 2/2007 |
| KR | 20-0257879 | Y1 | 12/2001 |
| KR | 10-2004-0033501 | A | 4/2004 |
| KR | 20-2010-0009785 | U | 10/2010 |

* cited by examiner

*Primary Examiner* — Raleigh W Chiu
(74) *Attorney, Agent, or Firm* — LRK Patent Law Firm

(57) ABSTRACT

The present invention relates to a game vending machine. The game vending machine includes: at least one premium hooking unit and a puller unit. The premium hooking unit hooks premium, and the puller unit pulls a front plate included in the premium hooking unit to allow the premium to drop down into a premium discharge part.

3 Claims, 6 Drawing Sheets

(a)

(b)

(a)

(b)

(c)

GAME VENDING MACHINE

TECHNICAL FIELD

The present invention relates to a game vending machine, and more particularly to a game vending machine which is configured such that a purchaser operates a key-shaped puller to acquire a prize, thereby efficiently arousing the purchaser's purchasing needs and interest.

BACKGROUND ART

Conventional methods of selling various toys including dolls through a game include a method in which a purchaser shoots a desired doll with an air gun to drop the doll, or a method in which a purchaser inserts a coin and then operates a lever to control a robot arm to pick up a toy stacked on a floor and to drop the toy to a discharge opening within a predetermined length of time.

A conventional game vending machine is configured such that when a user inserts a coin or a bill into an inserting slot and then operates a button, a pusher is moved horizontally and vertically along a guide to push a prize to be dropped into a prize discharge box.

In the game vending machine, if the pusher configured to be moved horizontally and vertically by operating the button was moved through a prize feeding hole in a prize plate formed in front of a display stand, a corresponding prize among various displayed prizes is dropped to and discharged through a take-out outlet. However, if the pusher configured to be moved horizontally and vertically by operating the button cannot pass through the prize feeding hole, it is impossible to take out the corresponding prize.

DETAILED DESCRIPTION OF THE INVENTION

Technical Problem

The present invention has been made in view of the above-mentioned problems, and an aspect of the present invention is to provide a game vending machine which allows a user (purchaser) to acquire various goods (prizes), including toys or dolls, through a game, thereby inducing the user's interest.

Technical Solution

In order to solve the technical problem, in accordance with an aspect of the present invention, there is provided a game vending machine including: at least one prize hanger unit configured to hang a prize; and a puller unit configured to pull a front plate provided in the prize hanger to allow the prize to be dropped to a prize discharge part.

The puller unit may be provided with a rotary body, which is configured to pass through a hole formed in the front plate and then to rotate to pull the front plate.

The rotary body may have a front face of a key shape formed by combining a circular shape and a rectangular shape, and the hole of the front plate may have a shape equal to that of the front face of the rotary body, in which the hole is larger than the front face.

The prize hanger unit may include: a slider unit coupled to an upper part of the rear side of the front plate; a case having a space for allowing the slide unit to be slid; and a support unit located between the bottom side of the case and the hole formed in the front plate, and configured to pass through a hole of a support bracket attached to the case to hang the prize on the support unit. When the puller unit pulls the front plate, the support unit may escape from the hole of the support bracket to allow the prize to be dropped to the prize discharge part.

The puller unit may include: a first assembly that encloses a part of the rear side of the rotary body, the first assembly being configured to control the rotary body to rotate 180 degrees with reference to its initial position after passing through the hole formed in the front plate; and a second assembly configured to move the first assembly backward to pull the front plate.

In accordance with another aspect of the present invention, there is provided a game vending machine including: a main body; at least one prize hanger unit configured to be fixed within the main body and to hang a prize; a moving unit installed within the main body, the moving unit being configured to be moved left and right by a chain linked to a first driving unit, and to be moved vertically by a belt linked to a second driving motor; and a puller unit arranged above the moving unit, the puller unit being configured to be moved back and forth by gears linked to a third driving motor. The puller unit may be configured to pass through a hole formed in a front plate provided in the prize hanger unit and then rotate to pull the front plate, thereby allowing the prize to be dropped to a prize discharge part.

Advantageous Effects

The inventive game vending machine can induce a user's purchasing needs and interest more actively by allowing the user to acquire various prizes including dolls or toys through a game.

Since the inventive game vending machine is a new type of game machine that allows the user to acquire a prize by making the puller pass through a keyhole-shaped hole and then pull the front plate formed with the hole, it is possible to increase the user's desire to take out a prize, thereby increasing the income of the game vending machine administrator.

BRIEF DESCRIPTION OF THE DRAWINGS

The above and other aspects, features and advantages of the present invention will be more apparent from the following detailed description taken in conjunction with the accompanying drawings, in which.

MODE FOR CARRYING OUT THE INVENTION

Figure 1:
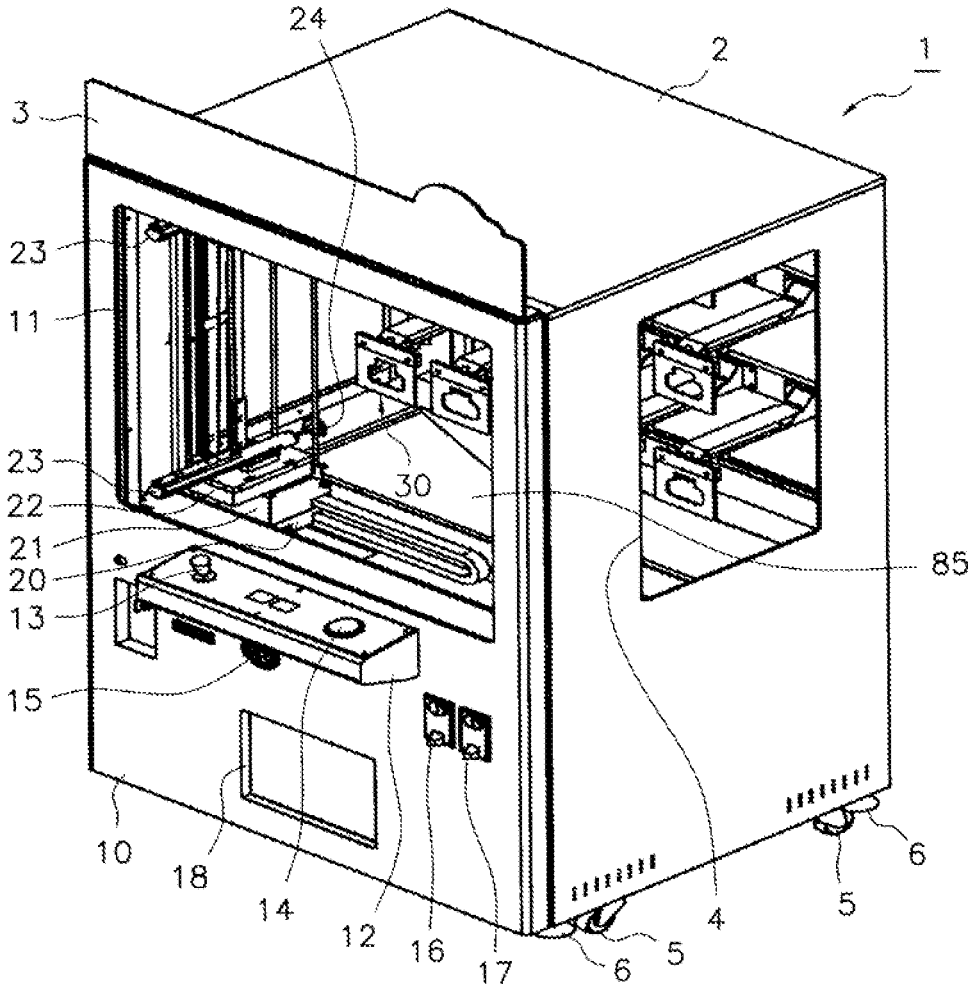
FIG. 1 is a perspective view illustrating the entirety of a game vending machine in accordance with an exemplary embodiment of the present invention.

In order to understand the present invention and the objects thereof accomplished by implementing the present invention, it is necessary to refer to accompanying drawings exemplifying various exemplary embodiments and contents described in the drawings.

The exemplary embodiments are now described with reference to the accompanying drawings in detail. In the following description, the same elements will be designated by the same reference numerals although they are shown in different drawings.

FIG. 1 is a perspective view of a game vending machine 1 in accordance with an exemplary embodiment of the present invention.

Referring to FIG. 1, the game vending machine 1 includes a main body 2 and a door 10. The game vending machine 1 may be referred to as a pointer game machine.

The main body 2 serves as a case, and may be formed in a box shape. The material of the main body 2 may be a metal.

On the front side of the main body 2, a door 10 is installed which is capable of being opened/closed for maintenance and repair, in which on the upper part of the front side of the door 10, a transparent window 11 is formed which allows a user to confirm the progress of the game, and on the lower part of the front side of the door 10, a prize outlet 18 is formed which is configured to discharge a prize.

An operating panel 12 and coin inserting units 16 and 17 may be formed adjacent to the front transparent window 11 of the door 10, and an advertising board 3 may be installed on the upper part of the door 10 in which an advertisement may be put. The advertising board 3 may be constructed by any of an LED panel, an LCD panel and a fluorescence display device which can execute a dynamic advertisement. By executing a commercial advertisement, it is possible to further increase an operating profit and an advertisement effect.

A side transparent window (or a transparent plate) 4 may be installed on a side of the main body 2 which may allow the user to confirm the kind of prizes.

On the bottom of the main body 2, four rollers 5 are installed at the left and right sides to allow the main body 2 to be moved. In addition, on the bottom of the main body 2, four main body fixing units 6 are provided at the left and right sides to fix the position of the main body 2. Each of the main body fixing units 6 extends vertically to fix the main body 2 to a floor, such as the ground.

The coin inserting units 16 and 17 may be used to insert coins with different sizes. The user of the game vending machine 1 may visually confirm a process of moving a puller unit indicated by reference numerals 22, 23 and 24 to one of a plurality of prize hanger units 30 through the front transparent window 11.

The operating panel 12 is provided with an operating lever (or a joystick) 13 and an operating button 14. The user may operate the operating lever 13 and the operating button 14 to drop a prize, and then to take out the prize from the prize outlet 18.

The operating lever 13 controls the puller unit 22, 23 and 24 and a moving unit indicated by reference numerals 20 and 21 positioned below the puller unit 22, 23 and 24 to move left and right.

As illustrated in FIG. 1, the operating button 14 controls the puller unit 22, 23 and 24 to be moved upward, and then controls a key-shaped rotary body 24 installed in front of the puller unit 22, 23 and 24 to pass through a keyhole-shaped hole formed in each of the front plates of the prize hanger units 30 and then to be rotated by 180 degrees with reference to its initial position so that the rotary body 24 is caught by the lower part of the keyhole-shaped hole in the rear side of the corresponding front plate. Then, the operating button 14 controls the rotary body 24 to pull the front plate. When the puller unit 22, 23 and 24 pulls the front plate, the prize hung on the corresponding hanger unit 30 is dropped to a prize discharge part 19 (see FIG. 2), so that the user can take out the prize from the prize outlet 18 connected to the prize discharge part 19. The front plates may be fabricated from a transparent or semi-transparent synthetic resin.

That is, the game vending machine 1 in accordance with the present exemplary embodiment is configured in such a manner that the user inserts a coin into any of the coin inserting units 16 and 17 and then makes a prize (for example, a doll) hung on any of the prize hanger units 30 be dropped to the prize discharge part within a predetermined length of time by using the key-shaped rotary body 24 included in the puller unit 22, 23 and 24, thereby acquiring the prize through the prize outlet 18.

A speaker 15 may produce an effect sound (a cheerful sound) to induce interest when the user operates the operating lever 13 and the operating button 14 after inserting a predetermined amount of money into any of the coin inserting units 16 and 17.

Figure 2:
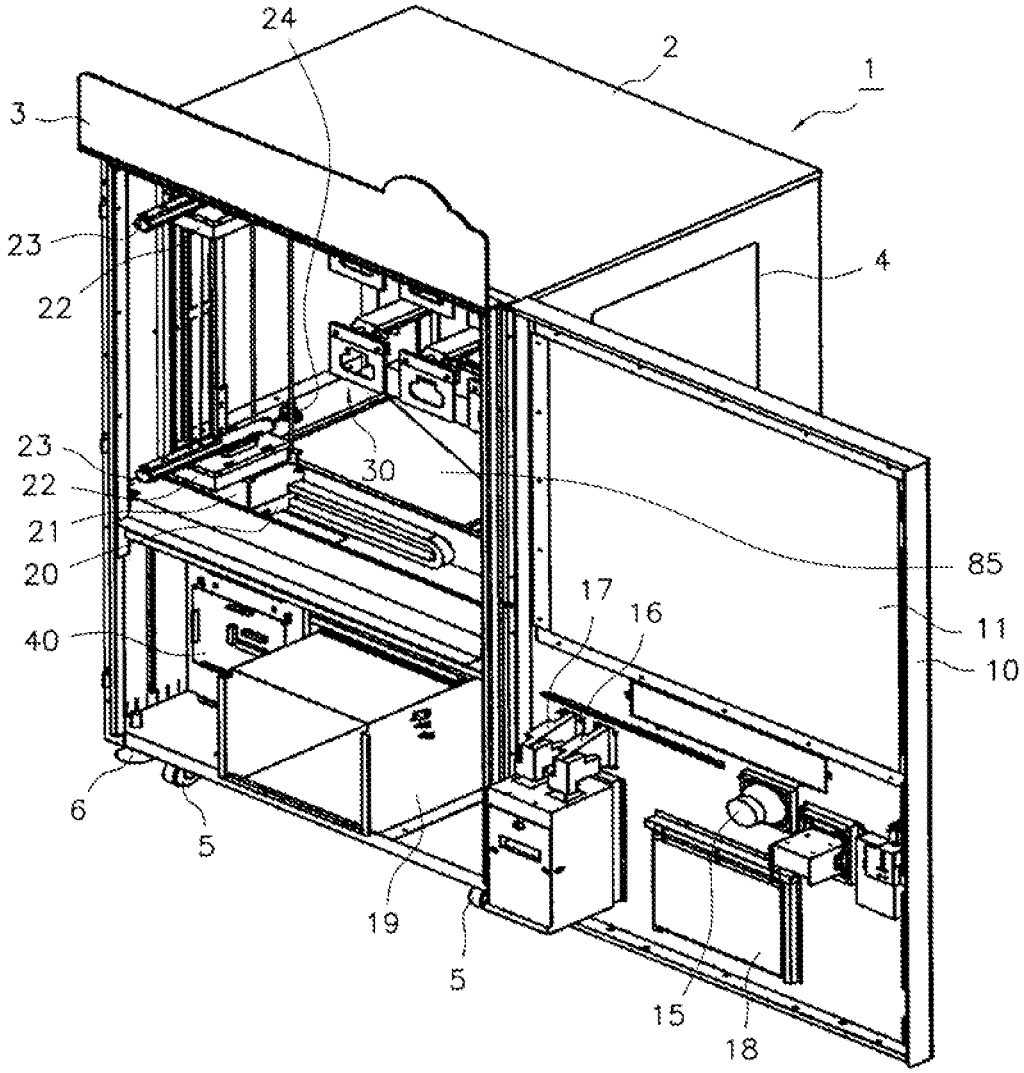
FIG. 2 is a perspective view illustrating the game vending machine of FIG. 1 in the state in which the door is opened.

FIG. 2 is a perspective view illustrating the game vending machine 1 of FIG. 1 in the state in which the door 10 is opened. Referring to FIG. 2, the game vending machine 1 includes a control unit 40 for controlling the actions of the moving unit 20 and 21 and the puller unit 22, 23 and 24 described above with reference to FIG. 1. The control unit 40 is electrically connected to the operating lever 13 and the operating button 14 illustrated in FIG. 1 to be functionally linked or coupled to the operating lever 13 and the operating button 14. The control unit 40 may be electrically connected to a power supply unit (not shown).

The prize discharge part 19 is formed in a box shape formed with an inside space, and a guide plate 85 for guiding a prize is coupled to the upper part of the rear side of the prize discharge part 19. The guide plate 85 has a downwardly inclined surface to guide the prizes to be smoothly received in the prize discharge part 19.

Figure 3:
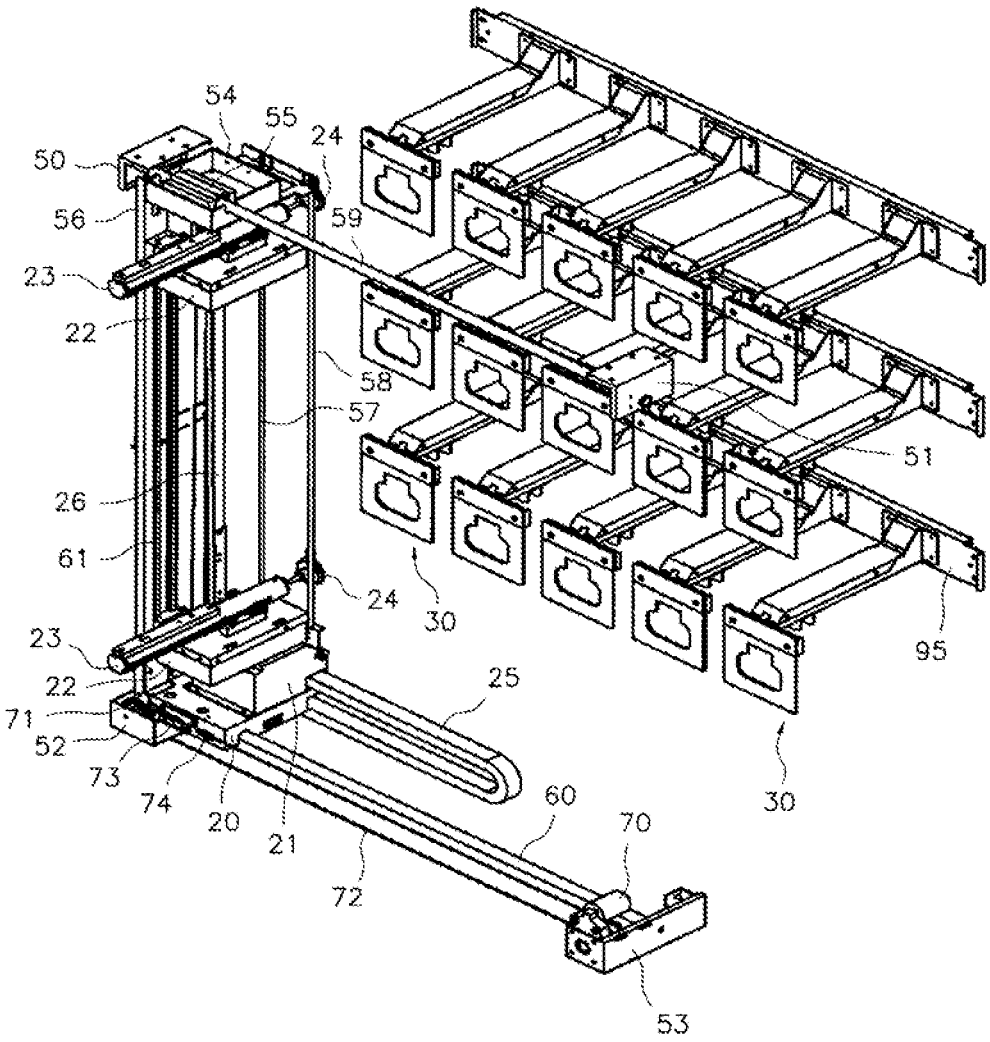
FIG. 3 is a perspective view for describing the inside configuration of the game vending machine illustrated in FIG. 1.

FIG. 3 is a perspective view for describing the inside of the game vending machine illustrated in FIG. 1.

Referring to FIG. 3, the game vending machine 1 may include at least one prize hanger unit 30 configured to hang a prize, and a puller unit 22, 23 and 24 configured to pull a front plate included in the prize hanger unit 30 so as to allow the prize to be dropped to a prize discharge part 19 (see FIG. 2).

The puller unit includes a first assembly 23, a second assembly 22 and a rotary body 24. FIG. 3 illustrates the puller unit in the state in which it is moved to the top side from the bottom side by a motor assembly 21 enclosed in the moving unit.

The rotary body 24 rotates after having moved through the hole formed in the front plate of any of the prize hanger units 30, thereby pulling the front plate. The prize hanger units 30 may be installed (fixed) on horizontal frames 95 within the main body by, for example, bolts.

Figure 5:
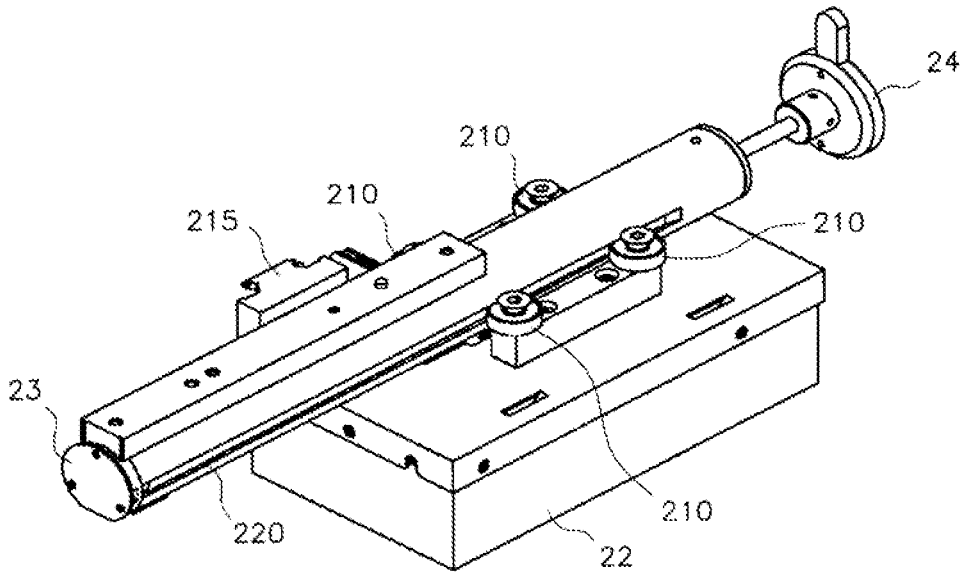
FIG. 5*a* is a perspective view for describing the puller unit illustrated in FIG. 4.
FIG. 5*b* is a side elevational view for describing the puller unit illustrated in FIG. 4.
Figure 5:
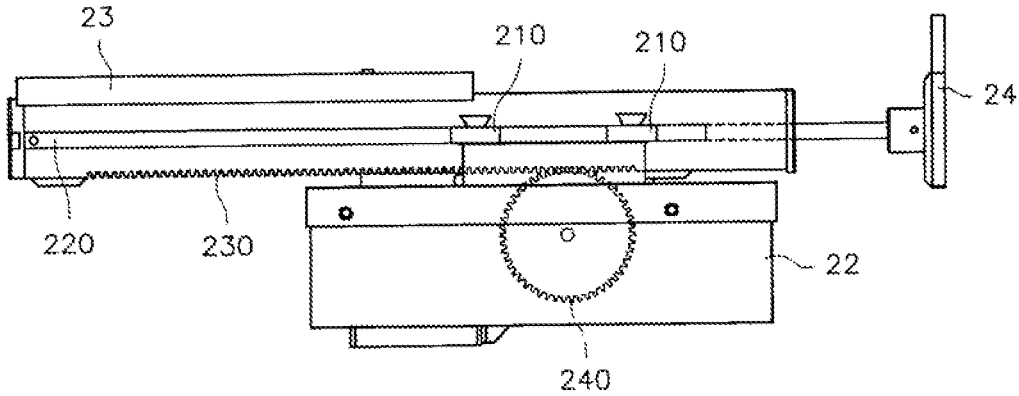

As illustrated in FIG. 5*a*, the rotary unit 24 has a key-shaped front face formed by a circular shape and a rectangular shape, and the hole in each of the front plates may have a shape equal to that of the front face of the rotary body, in which the hole is larger than the front face. Since the rotary body 24 is configured to have the key shape, the rotary body 24 may pass through the hole formed in the front plate and may pull the front plate. That is, the rectangular part in the key-shaped construction of the rotary body 24 is caught by the rear side of the front plate, and the rotary body 24 serves as a holder. According to another exemplary embodiment, the rotary body 24 may have a triangular front face, and the hole of each front plate may have a shape equal to that of the front face of the rotary body, in which the hole is larger than the front face. The rotary body 24 may be fabricated from a synthetic resin, such as acryl, or a metal.

The first assembly 23 may include a part of the rear side of the rotary body 24, and may be mechanically controlled to rotate, for example, by 180 degrees with reference to the initial position after having passed through the hole formed in each of the front plates. The second assembly 22 moves the first assembly 23 backward, thereby pulling the front plate.

Figure 4:
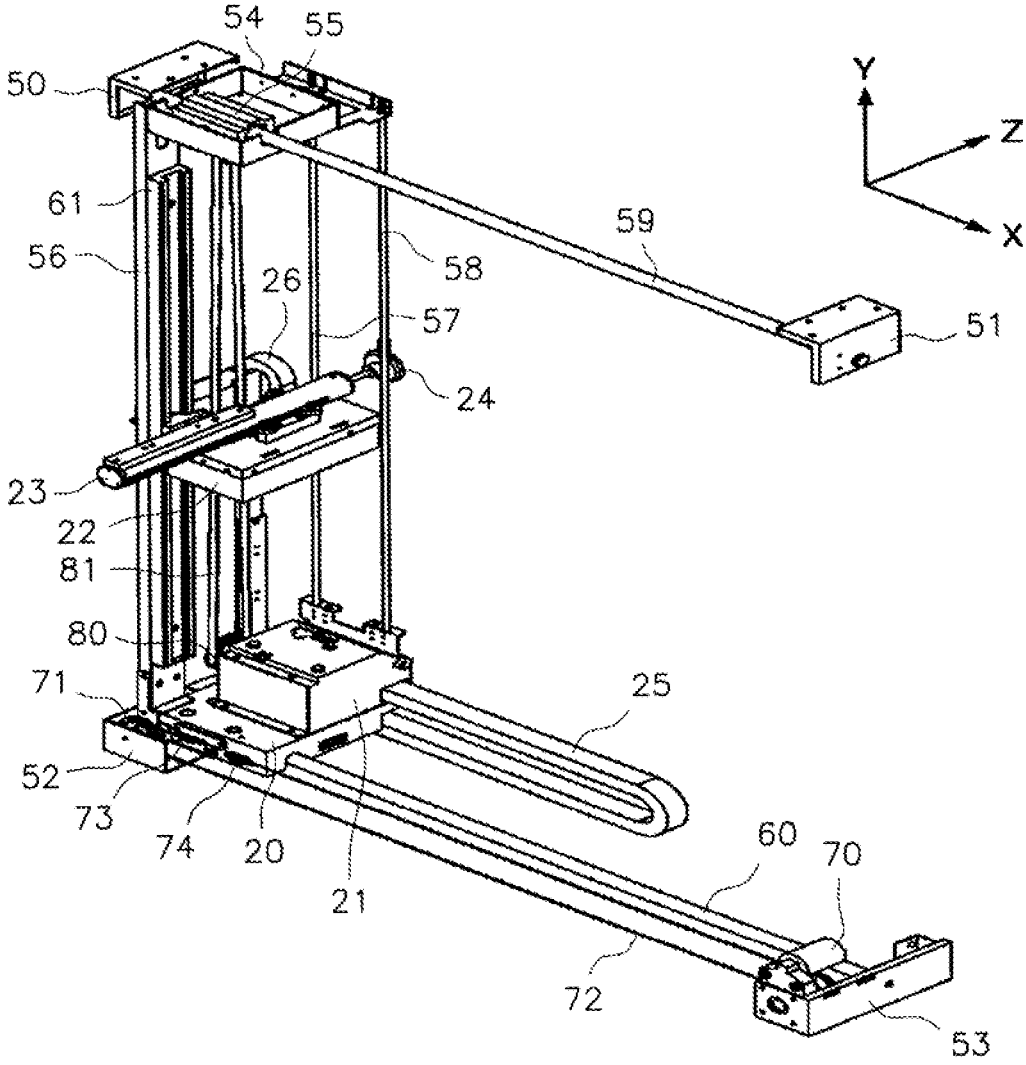
FIG. 4 is a perspective view for describing the actions of the moving unit and the puller unit illustrated in FIG. 3 in more detail.

FIG. 4 is a perspective view for describing in more detail the actions of the moving unit and the puller unit illustrated in FIG. 3.

Referring to FIG. 4, the moving unit includes a support block 20 and a motor assembly 21. The moving unit may be referred to as an X-axis moving unit. The support block 20 supports the motor assembly 21, and the motor assembly 21 may be coupled to the support block 20 by bolts.

On a side of the support block 20, a driven gear 71 is installed, and the motor assembly 21 includes a driving motor. A driving pulley (or a belt pulley) 80 is connected to the driving shaft of the driving motor.

A side edge of the support block 20 is coupled to a side edge of a guide box 54 by a support frame (vertical frame) 56. A Y-axis guide (Y-axis guide rail) may be attached to the support frame 56 by rivets. The top end of the motor assembly 21 is coupled to the bottom end of the guide box 54 by support rods 57 and 58. Each of the support rods 57 and 58 has a circular cross-section.

That is, due to the above-described connective relationship, the moving unit 20 and 21, the puller unit 22, 23 and 24, and the guide box 54 arranged above the moving unit 20 and 21 are moved as a unit.

The moving unit 20 and 21 and the puller unit 22, 23 and 24 are moved (slid) left and right (in the X-axis direction) along a bottom side X-axis guide (X-axis guide rail) 60 and a top side X-axis guide 59 by a chain motor 70 mounted on a fixing bracket 53, the driven gear 71 of the support block 20 and a chain 72. A sprocket is provided on the driving shaft of the chain motor 70.

When the moving unit 20 and 21 and the puller unit 22, 23 and 24 are moved, a groove formed on the bottom side of the support block 20 and a guide block 55 located within the guide box 54 are used, and a X-axis wiring cable (X-axis wiring cable chain) 25 may be flexibly moved when the moving unit is moved left and right. The guide block 55 has an opening in the inside thereof, and may be referred to as a bearing. The X-axis wiring cable chain 25 may include a wiring for driving the driving motor included in the motor assembly 21.

Both ends of the chain 72 are connected to a side of the support block 20 by anchor pins 73 and 74. The bottom side X-axis guide 60 is coupled to two fixing brackets 52 and 53 which are in turn fixed to the main body 2. The top side X-axis guide 59 is coupled to two fixing brackets 50 and 51, which are in turn fixed to the main body 2. The fixing brackets may be coupled to an inner plate of the main body 2 through a coupling process, such as bolting or riveting.

The puller unit 22, 23 and 24 is moved vertically (in the Y-axis direction) along the Y-axis guide 61 by the driving motor provided within the motor assembly 21, the driven pulley installed on the bottom side of the guide box 54 and a belt 81.

When the puller unit 22, 23 and 24 is moved, a groove formed on the Y-axis guide 61 and a slide unit included in the puller unit may be used, and a Y-axis wiring cable (Y-axis wiring cable chain) 26 may be flexibly moved. The puller unit may be referred to as a Y-axis moving unit. The Y-axis wiring cable 26 may include a wiring for driving a driving motor included in the second assembly 22 of the puller unit or driving a driving motor included in the first assembly 23. Like the both ends of the chain 72 being connected on the side of the support block 20 by the anchor pins 73 and 74, both ends of the belt 81 are connected to a side of the second assembly 22 by a connecting method similar to that of the chain 72 although not illustrated in FIG. 4.

Since the rotary body 24 and the first assembly 23 included in the puller unit are moved back and forth (in the Z-axis direction) as described above, the puller unit may perform the function of a Z-axis moving unit.

In summary, the moving unit is installed within the main body, and when the chain motor 70, which is the first driving motor, is driven, the moving unit is moved left and right by the chain 72 linked to the chain motor 70. In addition, when a driving motor, which is included in the motor assembly 21 as the second driving motor, is driven, the moving unit is moved vertically by the belt 81 linked to the second driving motor.

The puller unit is located above the moving unit, and when a driving motor which is included in the second assembly 22 as the third driving motor, is driven, the puller unit may be moved back and forth by gears linked to the third driving motor. The puller unit passes through the hole formed in the front plate installed on the at least one hole fixed within the main body and hanging a prize, and then rotates to pull the front plate, thereby dropping the prize.

In the exemplary embodiments described above, although it has been described that the leftward and rightward movement of the moving unit is conducted by the chain, the vertical movement of the puller unit is conducted by the belt, and the back and forth movement of the puller unit is conducted by the gears, in another exemplary embodiment, the leftward and rightward movement of the moving unit, the vertical movement of the puller unit and the back and forth movement of the puller unit may be conducted by any of chain, belt and wire or by a combination thereof. A motor corresponding to the chain, belt or wire may be included in the other exemplary embodiment.

FIG. 5*a* is a perspective view for describing the puller unit illustrated in FIG. 4. FIG. 5*b* is a side elevational view for describing the puller unit in FIG. 4.

Referring to FIGS. 5*a* and 5*b*, the puller unit includes a first assembly 23, a second assembly 22 and a rotary body 24.

The first assembly 23 including a part of the rear side of the rotary body 24 may be moved back and forth (in the Z-axis direction) by the driving motor included in the second assembly 22. The part of the rear side of the rotary body 24 may have a circular cross-section. As the first assembly 23 is moved backward, the front plate of a prize hanger unit may be pulled. A pinion gear 240 included in the second assembly 22 is coupled to the driving shaft of the driving motor, and a rack gear 230 is formed on the bottom of the first assembly 23. The pinion gear 240 tooth-meshes with the rack gear 230 such that the first assembly 23 including the rotary body 24 is moved back and forth.

When the first assembly 23 is moved, four guide rollers 210 formed on the top of the second assembly 22 are slid along two slide grooves 220 formed on a side of the first assembly 23.

A slide unit 215 is slid along a slide groove formed on the Y-axis guide 61 when the puller unit is moved vertically (in the Y-axis direction) and attached to the side of the second assembly 22.

The first assembly 23 may include a motor for rotating the rotary body 24, for example, by 180 degrees with reference to its initial position. In accordance with another exemplary embodiment of the present invention, the rotary body 24 may be rotated only by an angle that can pull the front plate of the prize hanger unit. For example, the rotating angle of the rotary body may be 90 degrees. The rotating action of the rotary body 24 may be clockwise or counterclockwise.

Figure 6:
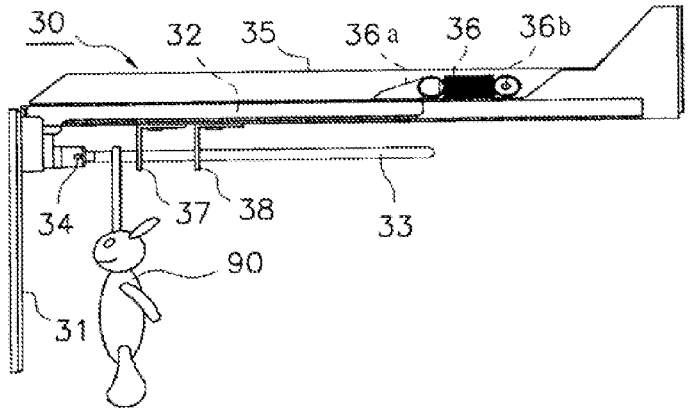
FIG. 6*a* is a side elevational view of a prize hanger unit when its front plate has not moved.
FIG. 6*b* is a perspective view of the prize hanger unit when its front plate has moved.
FIG. 6*c* is a side elevational view of the prize hanger unit when its front plate has moved.
Figure 6:
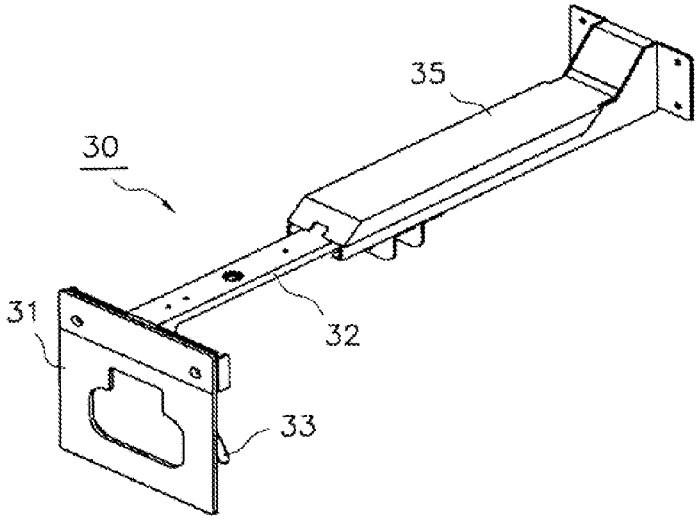
Figure 6:
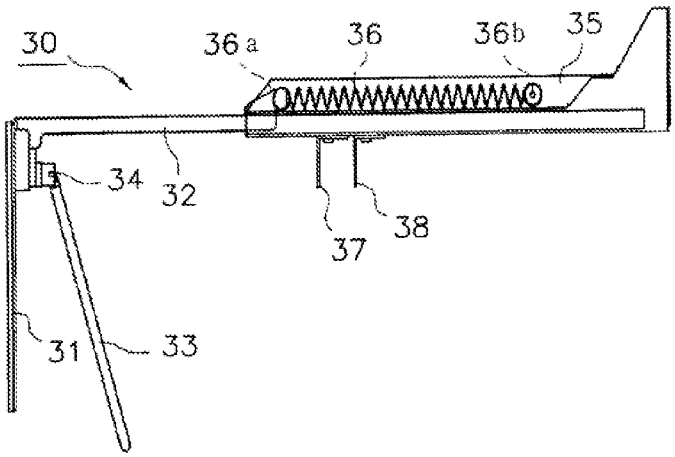

FIG. 6*a* is a side elevational view of a prize hanger unit 30 when the front plate of the prize hanger unit does not move, FIG. 6*b* is a perspective view of the prize hanger 30 when the front plate of the prize hanger has moved, and 6*c* is a side elevational view of the prize hanger 30 when the front plate of the prize hanger has moved.

Referring to FIGS. 6*a* to 6*c*, the prize hanger unit 30 includes a front plate 31 and a case 35. The prize hanger unit 30 may be referred to as a prize hanger assembly.

A slide unit 32 may be coupled to an upper part of the rear side of the front plate 31. The case 35 has an inside space which allows the slide unit 32 to be slid. A support unit 33 is arranged between the bottom of the case 35 and a keyhole shaped hole formed in the front plate 31, in which the support unit 33 may extend through holes of support brackets 37 and 38 which are attached to the bottom of the case 35, thereby allowing a prize 90 to be hung on the support unit 33. According to another exemplary embodiment of the present invention, a single support bracket may be provided. The support units 33 are joined by an anchor pin 34 to the front plate 31 to be movable vertically. The prize 90 may be, for example, a doll or accessory having a hanging cord.

One end of a spring 36 enclosed in the upper part of the case 35 is fixed to the case 35 by a fixing part 36*b*, and the other end of the spring 36 is connected to the upper part of rear side of the slider unit 32 through a wire 36*a*. When the front plate 31 does not move, the spring 36 is maintained in the original compressed state.

When the front plate 31 is pulled and hence the puller unit is moved, the support unit 33 escapes from the holes of the support brackets 37 and 38 as illustrated in FIG. 6*c*, thereby allowing the prize 90 to be dropped to the prize discharge part 19 (see FIG. 2). When the puller unit does not further pull the front plate 31 after the prize 90 has been dropped, the spring 36 pulls the slide unit 32 to return the prize hanger unit 30 to its original position as illustrated in FIG. 6*a*.

The operation of the inventive game vending machine will be described with reference to FIGS. 1 to 6*c*.

A user (purchaser) inserts a coin of a predetermined amount of money into any of the coin insertion units 16 and 17 provided on the door 10 of the main body 2, and then selects one prize hanger unit, on which a prize desired by the user is hung, among a plurality of prize hanger units 30 provided in the main body 2.

In order to move the puller unit 22, 23 and 24 located above the moving unit 20 and 21 to the selected prize hanger unit, the user operates the operating lever 13 provided on the door 10 to move the puller unit to an X-axis position corresponding to the selected prize hanger unit. The puller unit is moved in the X-axis direction along the X-axis guides 59 and 60 by the first driving motor 70 and the chain 72.

Thereafter, the user pushes the operating button 14 provided on the door 10 to move the puller unit to a Y-axis position corresponding to the selected prize hanger unit. When the puller unit arrives at the Y-axis position, the user may stop pushing the operating button 14. The puller unit is moved in the Y-axis direction along the Y-axis guide 61 by the second driving motor and the belt 81 included in the motor assembly 21.

When the user stops pushing the operating button 14, the puller unit is automatically moved forward (in the Z-axis direction) toward the selected prize hanger unit. The puller unit is moved in the Z-axis direction by the driving motor included in the second assembly 22, the pinion gear 240 included in the second assembly 22, and the rack gear 230 formed in the first assembly 23. When the rotary body 24 of the puller unit 24 passes through the key-hole shaped hole formed in the front plate of the selected prize hanger unit, the rotary body of the puller unit automatically rotates by 180 degrees with reference to its initial position and pushes the front plate of the selected prize hanger unit, thereby allowing the prize to be dropped to the prize discharge part 19. The rotary body 24 of the puller unit is rotated by the motor included in the first assembly 23. Then, the user can take out the prize through the prize outlet 18.

When the rotary body 24 of the puller unit cannot pass through the keyhole shaped hole formed in the front plate of the selected prize hanger unit or the prize is dropped by the rotary body 24, the puller unit retains a standby condition by being moved (returned) to its initial position which is the leftmost and bottom side direction as illustrated in FIG. 1. The situation in which the rotary body 24 cannot pass through the hole of the front plate is caused by a difference between a moving value of the puller unit and a positional value of the hole of the front plate, and when the rotary body 24 cannot pass through the hole of the front plate, the rotary body 24 runs into the front plate.

The operating lever 13, the operating button 14, the coin insertion units 16 and 17, the speaker 15, the advertising board 3, etc. are electrically connected to the control unit 40 and the power supply unit (not shown), and the control unit 40 controls the actions of the puller unit, the moving unit, the speaker, the advertising board, and the other components included in the inventive game vending machine in the entirety.

The invention has been described in connection with various aspects in the specification and drawings. Although specific terms are used therein, they are merely used for the purpose of describing the present invention rather than limiting a technical meaning or the scope of the present invention defined by the claims. Therefore, it will be appreciated by a person having an ordinary skill in the art that various modifications and equivalent embodiments can be made from the present invention. Therefore, the true technical scope of the present invention to be protected shall be determined by the technical idea defined in the claims.

The invention claimed is:

1. A game vending machine comprising:

at least one prize hanger unit configured to hang a prize; and a puller unit configured to pull a front plate provided in the prize hanger unit to allow the prize to be dropped to a prize discharge part, wherein the puller unit is provided with a rotary body, which is configured to pass through a hole formed in the front plate and then to rotate to pull the front plate, and wherein the rotary body has a front face of a key shape formed by combining a circular shape and a rectangular shape, and the hole of the front plate has a shape equal to that of the front face of the rotary body, the hole being larger than the front face.

2. A game vending machine comprising:

at least one prize hanger unit configured to hang a prize; and a puller unit configured to pull a front plate provided in the prize hanger unit to allow the prize to be dropped to a prize discharge part, wherein the prize hanger unit comprises:

a slider unit coupled to an upper part of a rear side of the front plate;

a case having a space for allowing the slide unit to be slid; and a support unit located between the bottom side of the case and the hole formed in the front plate, and configured to pass through a hole of a support bracket attached to the case to hang the prize on the support unit, and wherein, when the puller unit pulls the front plate, the support unit escapes from the hole of the support bracket to allow the prize to be dropped to the prize discharge part.

3. A game vending machine comprising:

at least one prize hanger unit configured to hang a prize; and a puller unit configured to pull a front plate provided in the prize hanger unit to allow the prize to be dropped to a prize discharge part, wherein the puller unit is provided with a rotary body, which is configured to pass through a hole formed in the front plate and then to rotate to pull the front plate, wherein the rotary body has a front face of a key shape formed by combining a circular shape and a rectangular shape, and the hole of the front plate has a shape equal to that of the front face of the rotary body, the hole being larger than the front face, and wherein the puller unit comprises:

a first assembly that encloses a part of the rear side of the rotary body, the first assembly being configured to control the rotary body to rotate 180 degrees with reference to its initial position after passing through the hole formed in the front plate; and a second assembly configured to move the first assembly backward to pull the front plate.

* * * * *